US005839629A

United States Patent [19]

Zuckerman

[11] Patent Number: 5,839,629

[45] Date of Patent: Nov. 24, 1998

[54] COLOR-CODED HANGER ASSEMBLY AND APPARATUS FOR MAKING SAME

[75] Inventor: Andrew Zuckerman, Forest Hills, N.Y.

[73] Assignee: Carlisle Plastics, Inc., North Bergen, N.J.

[21] Appl. No.: 871,282

[22] Filed: Jun. 9, 1997

[51] Int. Cl.[6] ..... A47G 25/14

[52] U.S. Cl. ..... 223/85

[58] Field of Search ..... 223/85, 92, 95, 223/98, 1

[56] References Cited

U.S. PATENT DOCUMENTS

| | | | |
|---|---|---|---|
| 2,920,801 | 1/1960 | Batts . | |
| 3,767,092 | 10/1973 | Garrison et al. . | |
| 4,031,270 | 6/1977 | Barnes | 223/85 |
| 4,807,334 | 2/1989 | Blanchard . | |
| 5,020,705 | 6/1991 | Garrison . | |
| 5,078,307 | 1/1992 | Suddath | 223/85 |
| 5,183,191 | 2/1993 | Garrison et al. . | |
| 5,277,345 | 1/1994 | Osaki | 223/85 |
| 5,516,014 | 5/1996 | Garrison . | |
| 5,535,927 | 7/1996 | Garrison . | |
| 5,622,759 | 4/1997 | Fuster | 428/40.2 |

*Primary Examiner*—Bibhu Mohanty
*Attorney, Agent, or Firm*—Amster, Rothstein & Ebenstein

[57] ABSTRACT

A color-coded hanger assembly is formed of a hanger and a spray coating The hanger includes an injection molded hanger body formed of plastic of a first color and a hook for suspending the hanger body. The spray coating is of a second color contrasting with the first color, is disposed in at least one or more selected areas of the hanger body adapted to receive and support clothing, and enhances the friction between the selected areas and clothing placed thereon. The second color indicates the areas of the hanger body on which clothing is to be placed by the user for enhanced frictional engagement. Apparatus for assembling an injection molded hanger body formed of plastic and a separately formed second component of the hanger, additionally includes a spray for depositing, on at least one or more selected areas of the hanger body adapted to receive and support clothing, a friction-enhancing spray coating.

3 Claims, 3 Drawing Sheets

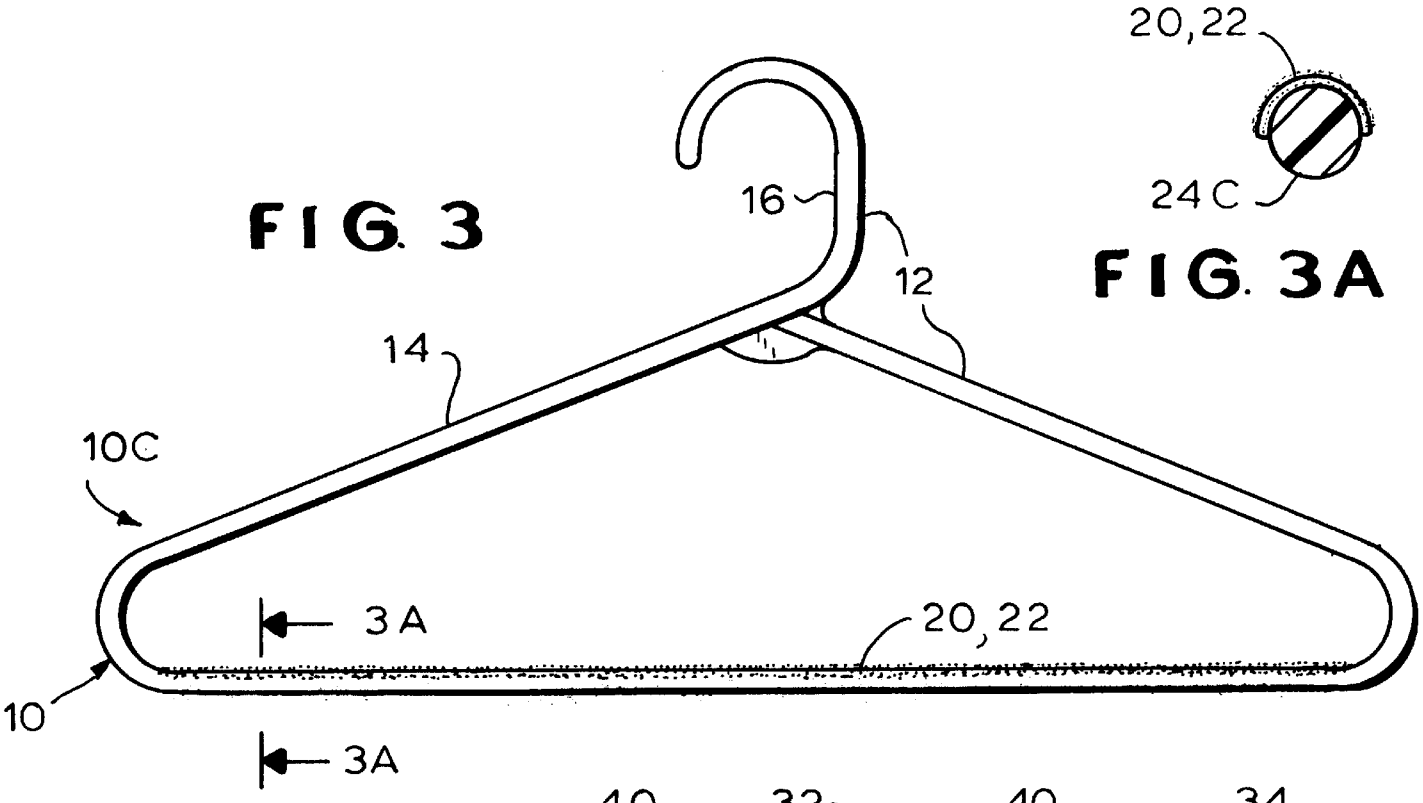
FIG. 3A
FIG. 3
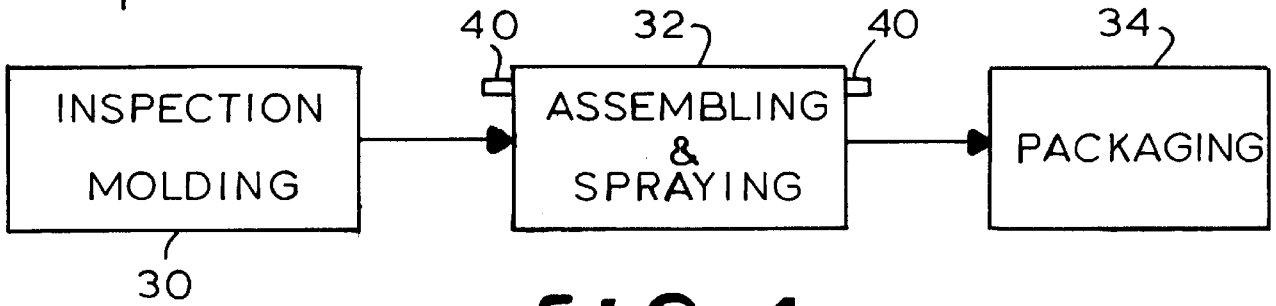
FIG. 4

COLOR-CODED HANGER ASSEMBLY AND APPARATUS FOR MAKING SAME

BACKGROUND OF THE INVENTION

The present invention relates to a hanger having areas providing enhanced frictional engagement between the injection molded plastic of the hanger body and clothing placed thereon, and more particularly to such a hanger assembly wherein the areas of enhanced frictional engagement are indicated to the user.

A hanger body formed of plastic is simply and inexpensively produced in massive quantities by injection molding. The hanger body is typically later assembled with one or more separately formed second components of the hanger in order to form a completed hanger. The second component is typically formed of metal. The second component may be a metal hook for suspending the hanger body according to conventional techniques. Alternatively, where the hanger is of the type having pairs of opposed plastic fingers for suspending a pair of pants, the second component may be a pair of spring clips which provide the resilient holding action by pressing opposed fingers of the hanger body towards one another in the conventional manner.

Because the injection molded plastic hanger body typically has a low coefficient of friction, it is not well suited for holding clothing thereon. For example, shirts and jackets tend to fall off the shoulders or wings of the hanger body, while pants tend either to slip off a horizontal cross member or rod connecting the ends of the shoulders or to slide through the biased opposed fingers.

Various attempts have been made to overcome this serious deficiency of the injection molded hanger body because of its attractive economical mass manufacture by injection molding. For example, felt or rubberized strips have been adhered to the top of hanger body shoulders or otherwise attached to the hanger body (for example, by being slipped over edges thereof) in order to increase the frictional engagement thereby. Similarly, felt or rubberized strips have been secured (for example, by gluing) to the clothing-engaging surfaces of the hanger body fingers in order to increase the frictional engaging properties of the fingers. Alternatively, the clothing-receiving surfaces of the hanger body have been texturized—that is, provided with dimples, pimples, projections, recesses and the like—all for the same purpose of increasing the frictional engagement of the surfaces.

None of these techniques have proven to be entirely satisfactory in practice because they affect the contour and lay of the clothing fabric placed thereon. For example, shirt and jacket shoulders, which should lay smooth on the hanger body shoulders, may develop creases or projections corresponding to the felt or rubberized strips or texturizing on the hanger body shoulders. Again, pants and slacks may develop creases or projections where they have been engaged by felt or rubberized strips, texturizing, and the like.

It is also known to use a co-injection molding process to form the hanger body with the substance of the hanger body being formed of one plastic, and a second friction-enhancing material being co-injection molded on selected areas thereof. The heat retained by the one plastic during the curing thereof is thus also used to secure the friction-enhancing material to the plastic. However, this is an expensive process as it entails the dedication of an extra cycle of time for curing of the friction-enhancing material and hence diminishes productivity of the molding apparatus.

Finally, it is also known to spray a friction-enhancing material on an injection molded hanger body in a separate operation prior to packaging of the hanger for shipment. This requires a separate handling of the injection molded hanger body (or hanger) to expose it to the spray, independently of the handling otherwise required to manufacture and package the hanger. This labor-intensive operation is costly.

Because the friction-enhancing spray used on the injection molded hanger bodies is typically clear or colored the same as the injection molded hanger body, the purchasing public is often unaware that the hanger has been especially treated for enhanced friction (or where it has been so treated) so that the potential purchasers are not ready to devote an incremental unit of cost to the purchase for the advantage of having a hanger with friction-enhanced surfaces. Similarly, the user of the hanger may be confused as to whether there is a friction-enhanced surface, and, if so, where.

Accordingly, it is an object of the present invention to provide a color-coded hanger assembly wherein the injection molded hanger body is color-coded to indicate the presence of one or more areas coated for enhanced frictional engagement and, more particularly, the areas on which clothing is to be placed by the user for enhanced frictional engagement.

Another object is to provide such a hanger assembly which is economical to manufacture.

A further object is to provide apparatus for assembling an injection molded a hanger body with a separately formed second hanger component while substantially simultaneously applying a friction-enhancing coating to selected areas of the hanger body.

It is also an object of the present invention to provide such apparatus which enables the friction-enhanced hanger to be economically manufactured.

SUMMARY OF THE INVENTION

It has now been found that the above and related objects of the present invention are obtained in a color-coded hanger assembly. The assembly comprises a hanger including an injection molded hanger body formed of plastic of a first color and a hook for suspending said hanger body, and a spray coating of a second color contrasting with the first color. The spray coating is disposed in at least one or more selected areas of the hanger body adapted to receive and support clothing and enhances the friction between the selected areas and clothing placed thereon. The second color indicates the areas of the hanger body on which clothing is to be placed by the user for enhanced frictional engagement.

The present invention also encompasses apparatus for assembling an injection molded hanger body formed of plastic and a separately formed second component of the hanger. The apparatus additionally includes means for depositing, on at least one or more selected areas of the hanger body adapted to receive and support clothing, a friction-enhancing spray coating.

In a preferred embodiment, the plastic is of a first color, and the spray coating is of a second color contrasting with the first color and indicating the areas of the hanger body on which clothing is to be placed by the user for enhanced frictional engagement.

The second hanger component is preferably formed of metal. The second hanger component may be a hook for suspending the hanger body or a spring clip.

BRIEF DESCRIPTION OF DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 3 is an isometric view of a third color-coded hanger assembly according to the present invention;

FIG. 3A is a sectional view taken along the line 3A—3A of FIG. 3; and FIG. 4 is a schematic flow chart of apparatus for assembling an injection molded hanger body and at least one separately formed second hanger component.

DETAILED DESCRIPTION OF THE PREFERRED EMBODIMENTS

Figures 1, 1A:
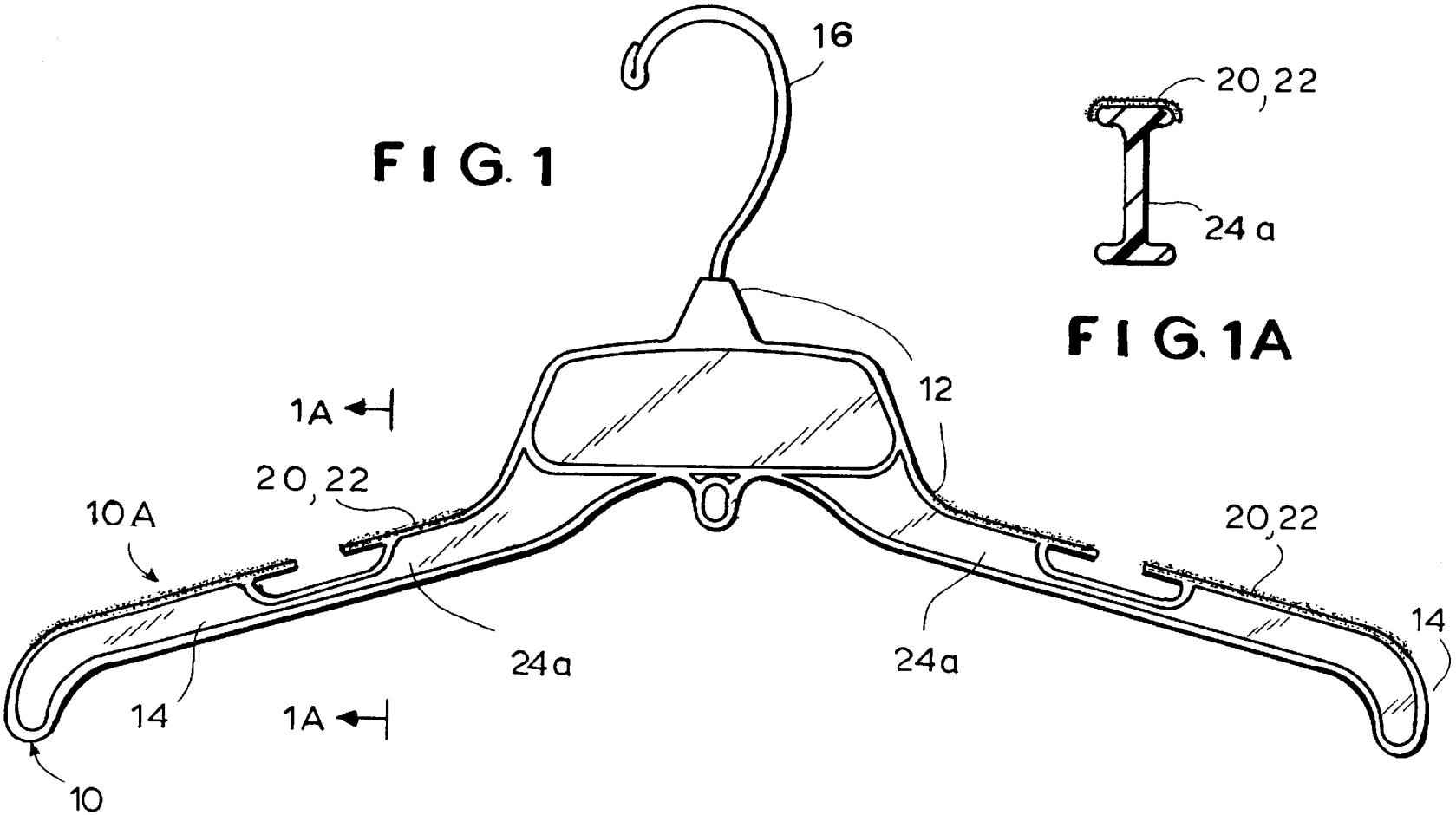
FIG. 1 is an isometric view of a first color-coded hanger assembly according to the present invention.
FIG. 1A is a sectional view taken along the line 1A—1A of FIG. 1.
Figure 2:
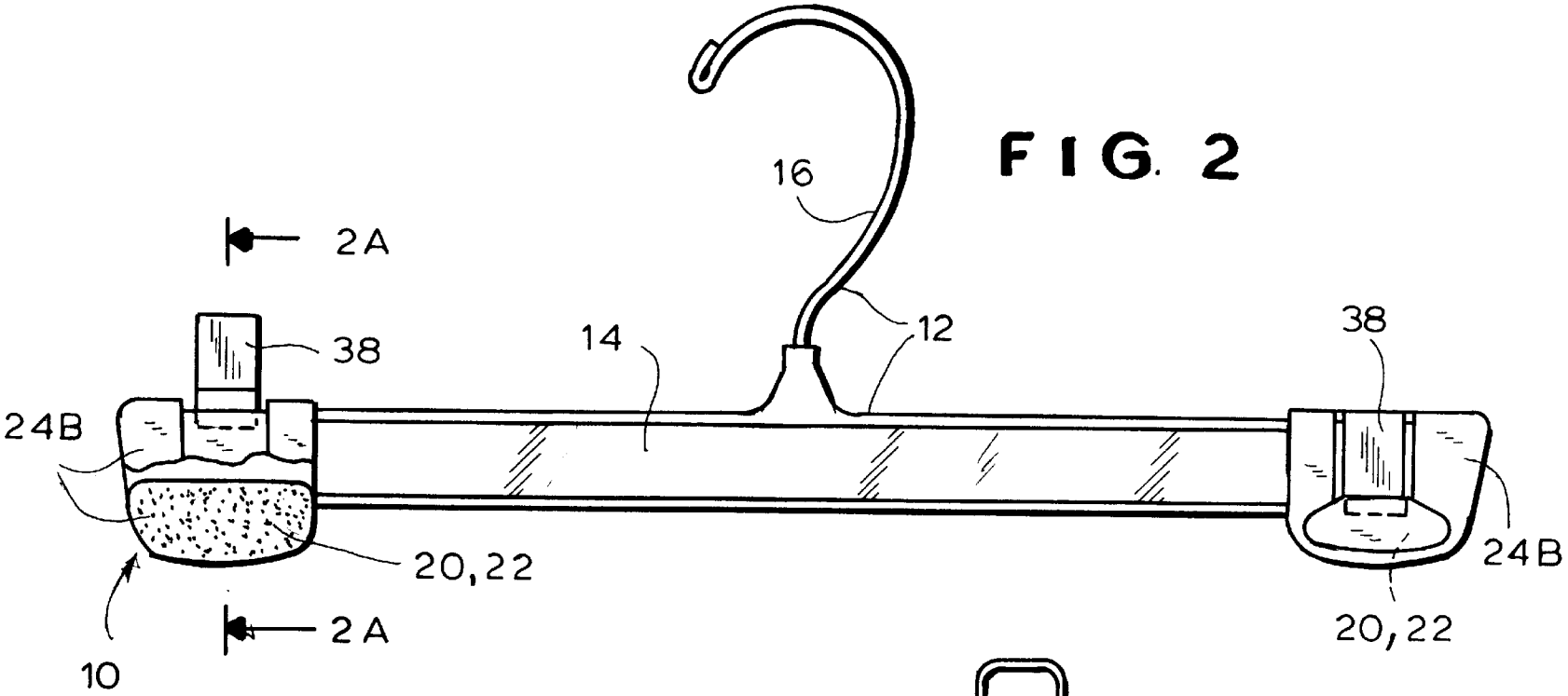
FIG. 2 is an isometric view of a second color-coded hanger assembly according to the present invention.

Referring now to the drawing, and in particular to FIGS. 1–3 thereof, therein illustrated are first, second and third embodiments, respectively, of a color-coded hanger assembly according to the present invention, generally designated by the reference numeral 10, and in particular the designations 10A, 10B and 10C, respectively. The assembly 10 comprises a hanger 12 including a hanger body 14 and a hanger hook 16 secured to said hanger body for suspending the hanger body 14—for example, from a closet rod or the like.

The hanger body 14 is injection molded from plastic of a first color. Preferably, the hanger body 14 is untexturized and devoid of any dimples, pimples, projections, recesses or like surface treatments of the plastic in order to enhance the friction-engaging properties thereof at the expense of the regularity of the contour and lay of clothing fabric placed thereon. Typical colors of the plastic include white, clear and black, although a variety of other colors may be used as well. Preferably the color is uniform over the entire hanger body 14.

The hanger assembly 10 additionally includes a spray coating 20 disposed in at least one or more selected areas 22 of the hanger body adapted to receive and support clothing. The spray coating 20 is non-toxic, adheres well to the injection molded plastic, and, most importantly, enhances the friction between the selected areas 22 and clothing placed thereon.

Figure 2A:
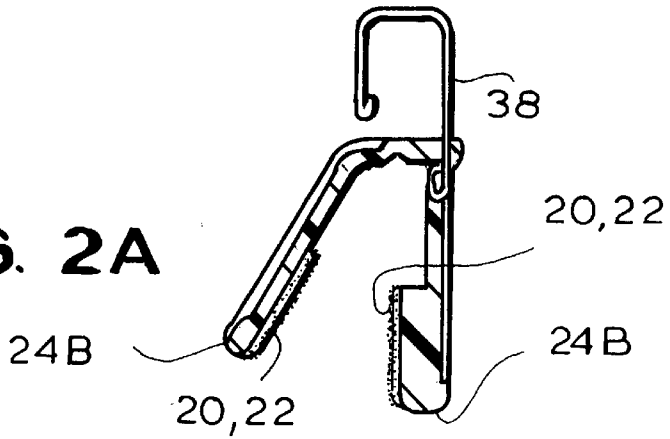
FIG. 2A is a sectional view taken along the line 2A—2A of FIG. 2.

It is a feature of the present invention that the spray coating 20 be of a second color (e.g., grey or red) contrasting with the first color—that is, the color of the injection molded hanger body 14—so that the second color serves to indicate to the user the areas of the hanger body on which clothing is to be placed by the user for enhanced frictional engagement by the hanger body. Such areas 22 might include in hanger 10A of FIGS. 1 and 1A the top surface (and optionally the side surfaces) of the shoulders or wings 24A of the hanger body 14, in hanger 10B of FIGS. 2, and 2A at least one of the opposing gripping faces of the hanger body finger pairs 24B adapted to grasp trousers therebetween, or in hanger 10C of FIGS. 3 and 3A the top surface (and optionally the side surfaces) of a horizontal rod 24C extending between the distal tips of the shoulders. Spraying may be onto one finger of each finger pair or onto both fingers of each finger pair. The second color need not be a solid color and is preferably mottled or speckled, thereby to provide a spotted or blotched, appearance suggesting a rough surface—that is, a surface of the type which might afford enhanced frictional engagement.

Preferably, the spray coating 20 is applied to the hanger body areas 22 after cooling of the injection molded hanger body. Where the spray coating is quick-drying at ambient temperature, there is no necessity for the retained heat of the injection molding process to be used for this purpose.

According to the present invention a friction-enhancing spray coating 22 is applied to selected areas 22 of a hanger body 14 within conventional apparatus for assembling the hanger body 14 and at least one separately formed second component of the hanger 12. Thus, referring now to FIG. 4, therein illustrated schematically is the hanger body injection molding apparatus 30, the hanger assembly apparatus 32, and the hanger assembly packaging apparatus 34.

The second hanger component is typically, but not necessarily, formed of metal. It may be a conventional hanger hook 16 for suspending the hanger body 14 from a closet rod or the like, a horizontally extending rod 24C for supporting pants thereover, or one or more conventional spring clips 38 disposed over portions of the outer surface of the plastic fingers 24B. Typically, the spring clip 38 is moveable upwardly to allow a slight separation of the plastic fingers 24B, and hence withdrawal of trousers therefrom, or downwardly over the outer surfaces of the plastic fingers 24B to urge the fingers inwardly—e.g., for grasping the trousers.

Preferably, the spray coating 22 is applied to the selected areas 22 of the hanger body 14 within the conventional apparatus 32 for assembling the hanger body 14 and at least one separately formed second component 16, 24B, 24C of the hanger 12, as noted above. Thus, the assembly apparatus 32 according to the present invention includes ,means 40 for applying the friction-enhancing spray coating 20. One or more spray means 40 are preferably mounted on, and become a part of the assembly apparatus 32. The spray apparatus 40 will be integrated with the assembly apparatus 32 at one or more locations which facilitate the spraying of the friction-enhancing coating onto the selected areas 22 without interference from other portions of the hanger or the assembly apparatus. As injection molding apparatus 30, assembly apparatus 32 and hanger packing apparatus 34 are each individually and in combination well known to those skilled in the art, further details thereof need not be provided herein.

In a preferred embodiment of the apparatus, the plastic of the injection molded fingers is of a first color, and the friction-enhancing spray coating applied by spray means 40 is of a second color contrasting with the first color, so that the second color indicates to the user the areas of the hanger body on which clothing is to be placed by the user for enhanced frictional engagement between the clothing and the areas.

To summarize, the present invention provides a color-coded hanger assembly wherein the injection molded hanger body is color-coded to indicate the presence of one or more areas of enhanced frictional engagement and, more particularly, the areas on which clothing is to be placed by the user for enhanced frictional engagement. The hanger assembly is economical to manufacture. The present invention further provides apparatus for assembling and injection molding the hanger body with at least one separately formed second hanger component while substantially simultaneously applying a friction-enhancing coating to selected areas of the hanger body. The apparatus enables the friction-enhanced hanger to be economically manufactured.

Now that the preferred embodiments of the present invention have been showed and described in detail, various modifications and improvements thereon will become really apparent to those skilled in the art. Accordingly, the spirit and scope of the present invention is to be construed broadly, and limited only by the appended claims, and not by the foregoing specification.

I claim:

1. A color-coded hanger assembly comprising:

(A) a hanger including an injection molded hanger body formed of plastic of a first color and a hook for suspending said hanger body; and (B) a spray coating of a second color contrasting with said first color, said spray coating being disposed in at least one or more selected areas of said hanger body adapted to receive and support clothing and enhancing the friction between said selected areas and clothing placed thereon;

said second color being mottled or speckled, thereby to provide a spotted or blotched appearance;

said second color indicating the areas of said hanger body on which clothing is to be placed by the user for enhanced frictional engagement.

2. In apparatus for assembling an injection molded hanger body formed of plastic and a separately formed second component of the hanger, the improvement wherein said apparatus additionally includes means for depositing, on at least one or more selected areas of said hanger body adapted to receive and support clothing, a friction-enhancing spray coating;

said plastic being of a first color, and said spray coating being of a second color contrasting with said first color and indicating the areas of said hanger body on which clothing is to be placed by the user for enhanced frictional engagement;

said second color being mottled or speckled, thereby to provide a spotted or blotched appearance.

3. The apparatus of claim 2 wherein said plastic is of a first color, and said spray coating is of a second color contrasting with said first color and indicates the areas of said hanger body on which clothing is to be placed by the user for enhanced frictional engagement.

* * * * *